United States Patent [19]

Curtis

[11] 4,186,663

[45] Feb. 5, 1980

[54] TRANSFORMER MOVABLE ALONG POWER CABLE

[76] Inventor: Westley F. Curtis, 9499 MacArthur Blvd., Washington, D.C. 20854

[21] Appl. No.: 713,070

[22] Filed: Feb. 3, 1958

[51] Int. Cl.[2] ..... B63G 9/00; F42B 22/26

[52] U.S. Cl. ..... 102/18 MS; 114/240 R

[58] Field of Search ..... 114/240, 240 A, 240.1, 114/240.2, 240.3, 240.4, 240.5, 241

[56] References Cited

U.S. PATENT DOCUMENTS

| | | | |
|---|---|---|---|
| 2,393,466 | 1/1946 | Greenfield | 114/240 R X |
| 2,404,440 | 7/1946 | Holm | 102/18 MS X |
| 2,419,053 | 4/1947 | Bennett | 114/240 R X |
| 2,668,512 | 2/1954 | Klas | 114/240 R |

*Primary Examiner*—David H. Brown

*Attorney, Agent, or Firm*—R. S. Sciascia; Q. E. Hodges

EXEMPLARY CLAIM

6. A torpedo detecting and explosive charge carrying mechanism comprising an electrically conductive cable, a shielding means adapted for slide on said cable for minimizing the effect of electrically induced eddy currents, and means for transferring power from said cable mounted within said shielding means.

9 Claims, 4 Drawing Figures

TRANSFORMER MOVABLE ALONG POWER CABLE

The invention described herein may be manufactured and used by or for the Government of the United States of America for governmental purposes without the payment of any royalties thereon or therefor.

This invention relates to a torpedo detector and transformer which are movable along a power cable. This application is a continuation of application Ser. No. 793,660 by Judd O. Baker et al filed Dec. 24, 1947, now abandoned, for Torpedo Guards.

This invention provides for a torpedo detector having a casing which is slidable along an electrically energized power cable and which contains an explosive charge and a power supply transformer for energizing a detector mechanism. The torpedo detector is for use under water to detect the approach of enemy torpedos and to explode them when the torpedos approach the ship which is to be protected. The system is disclosed in application Ser. No. 793,660, supra, and this invention relates to a particular torpedo detector, cable, and power supply.

At the outset, four basically different methods of supplying power to the detectors were considered, namely:

1. Batteries. It was considered probable that the weight of a battery power supply would be greater than the weight of competitive systems. Furthermore, if a battery with self-contained electrolyte were used, the shelf-life would be insufficient; if a sea-cell were used, length of service-life would be a problem and the introduction of sea water at launching would be difficult to reconcile with moistureproof protection for the battery before launching. Finally, if a battery were used, it would be very difficult to disarm the detectors after launching. 2. Water turbines, using water-flow past the detectors to drive electric generators. The turbine blades would almost certainly have to project beyond the streamlined 3-in. tube which houses the detector, in order to obtain sufficient power at low towing speeds; this introduces launching and stowage difficulties. Apparatus for making the electrical output independent of towing speed would be complex and of dubious reliability. The noise generated by the turbine would be a problem. It would be difficult to disarm the detectors without completely stopping the towing vessel.

3. Transformers, consisting of secondary coils wound on closed cores surrounding the cable, excited by an alternating current in the cable. It was anticipated that the efficiency of the transmission-transformer system would be low, and that variations in current along the length of the cable might give difficulty. However, the system provides ample shelf-life and service-life, great reliability, and the detectors can easily be disarmed from the ship.

4. Brushes, bearing on a bare metal cable carrying low-voltage power. It was anticipated that the efficiency of transmission would be low and the current distribution poor on account of the shunting effect of the sea water. It was also anticipated that, in order to keep the losses at all tolerable, the voltage would have to be so low that transformers would have to be used anyway, and that the contact resistance of the brushes would be troublesome.

In accordance with the invention, an electrically energized cable having a central conductor, insulation around the central conductor, and a metallic sheath placed around the insulation is provided. The torpedo detector comprises a central plastic tube adapted to slide on the cable, a transformer for transferring power from the central cable mounted coaxially with the plastic tube, and an outer metallic casing mounted on the plastic tube for supporting the explosive charge and detecting mechanism.

This invention is particularly useful for transferring electrical energy from a cable while being immersed in sea water or other highly conductive media. The short circuiting effects of induced eddy currents in the sea water render most conventional power transformer systems inoperative in this application.

A primary object of this invention is therefore to disclose an electrical power transfer device which may operate in sea water and have means for minimizing the effect of induced eddy currents despite the short circuiting effects of the sea water.

Another object of this invention is to present a method for transferring power from a cable which has a central conductor which is energized and an outer conductor which is not energized.

Other objects and advantages of the invention will hereinafter become more fully apparent from the following description of the annexed drawings, which illustrate a preferred embodiment, and wherein;

FIG. 1 discloses the torpedo detector casing and transformer power supply means for the torpedo detector slidable upon a power cable according to this invention.

FIG. 2 discloses a similar embodiment of this invention which uses an insulating layer and an outer metallic sheath on the central cable.

Figure 1:
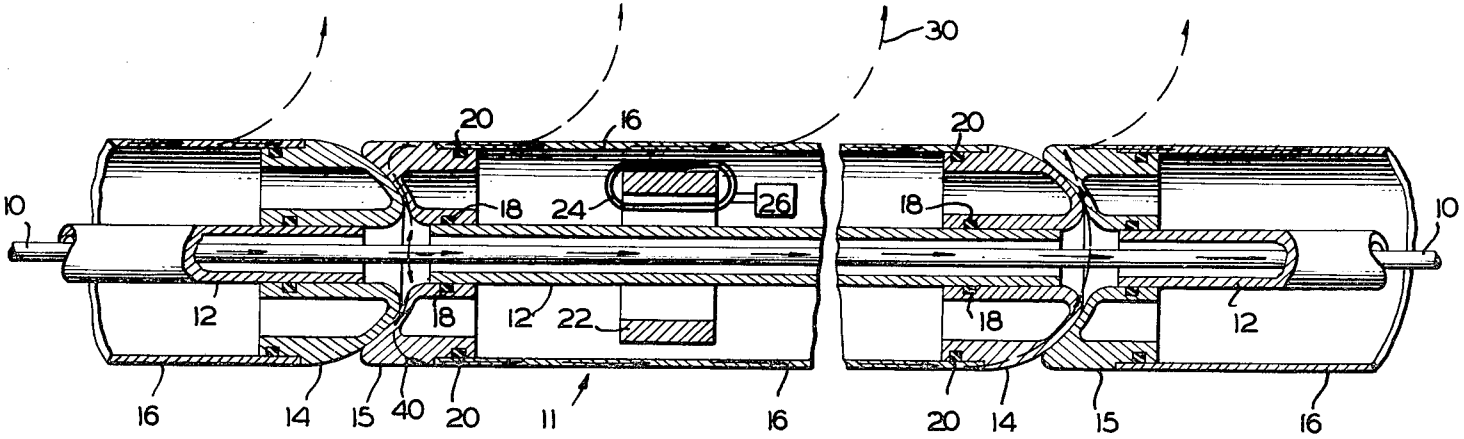

A specific embodiment of the invention is shown in FIG. 1 where a central conductor 10, which is towed from a ship by means of a paravane, is electrically energized. A torpedo detector 11 is shown adapted to slide on the central cable by means of a plastic inner tube 12. Attached to the inner tube 12 at the extremities thereof are two aluminum end plugs 14 and 15. End plug 14 is formed with an approximate ball shape and end plug 15 has a socket shape. This configuration allows a number of detectors to move angularly with respect to each other. The mating ends of the end plugs 14 and 15 are smooth fitted to allow a minimum amount of sea water to pass between them. The end plugs are sealed to the inner tube 12 by means of O-rings 18.

The outer casing 16, which is generally made of aluminum, is fitted to the end plugs 14 and 15 and sealed by means of O-rings 20. Mounted within the detector casing 16 is a power transformer core 22 which is mounted coaxially with the inner tube 12 and has windings 24 which supply power to a detector mechanism 26. A detonator and explosive charge (not shown) fill the remaining space in the detector.

In operation the central conductor 10 is energized by an alternating current of 800 cycles. The alternating magnetic field from conductor 10 produces a large magnetic flux in core 22 and therefore a voltage in the windings 24 which power the detector mechanism 26. Since no mechanical connection is made between the central conductor 10 and the transformer core 22, the torpedo detector 11 may slide along the central cable, such as is necessary when a detector detects a torpedo and explodes, thereby destroying itself and leaving an open gap along a string of detectors mounted on the cable.

Figure 2:
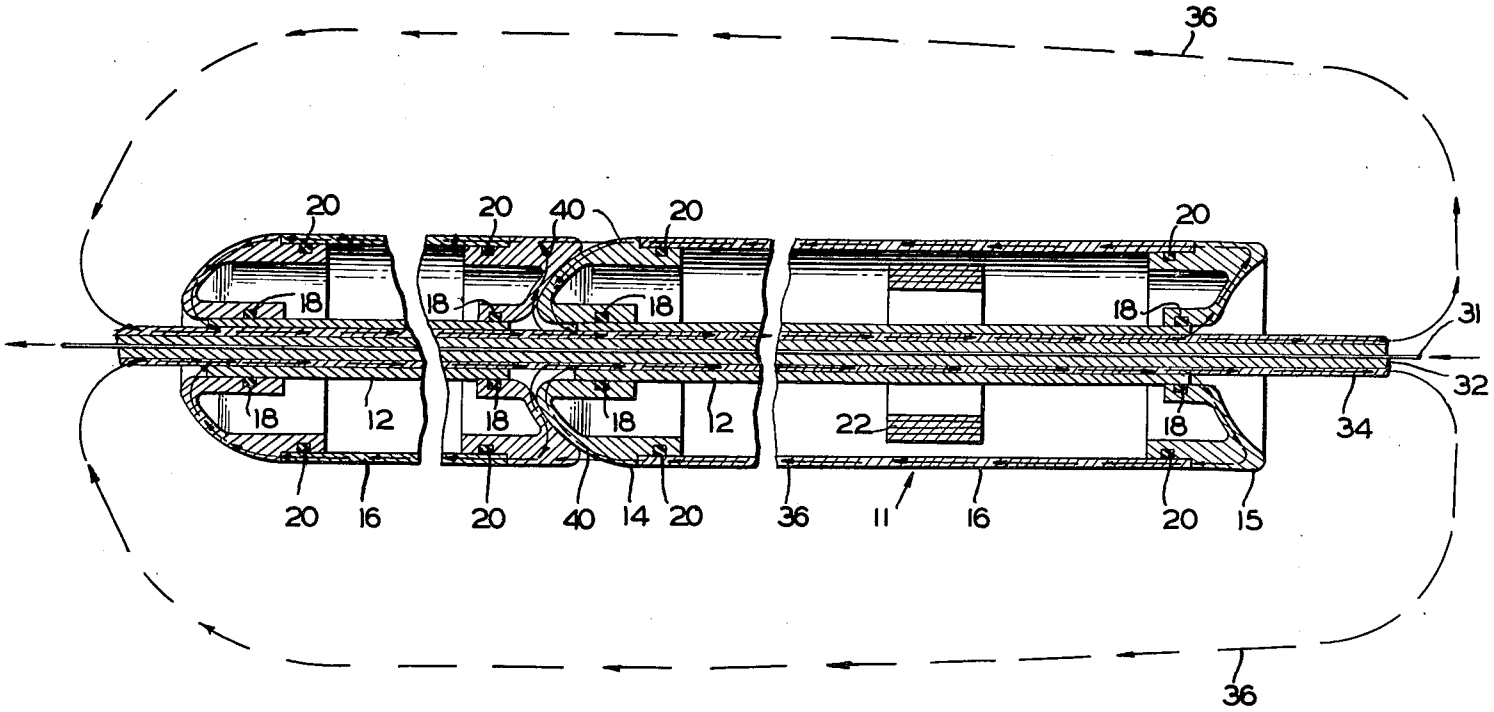

FIG. 2 discloses a similar embodiment of a detector mounted on a power cable where the power cable consists of a central conductor 31, an insulating layer 32 and an outer metallic sheath 34. The paths of the induced eddy currents in the outer sheath 34, through the aluminum end plugs, and through the sea water are indicated at 36.

Figure 3:
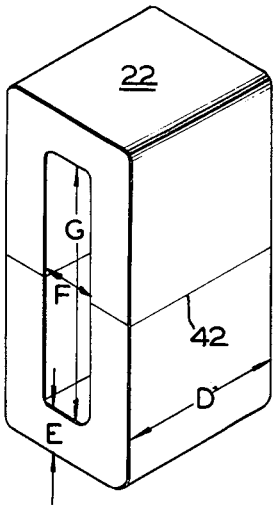
FIG. 3 is a perspective view of a typical transformer core showing the necessary dimensions.

FIG. 3 discloses a perspective view of a typical transformer core 22. When the explosive charge is detonated, the casing 16, end plugs 14 and 15 and plastic tube 12 are destroyed. The transformer core 22 is very strong, however, and therefore the core is cut in two pieces and glued together as shown at line 42 to allow the core to be blown away from the cable. The remaining detectors 11 then slide along the cable and fill up the empty spaces.

Figure 4:
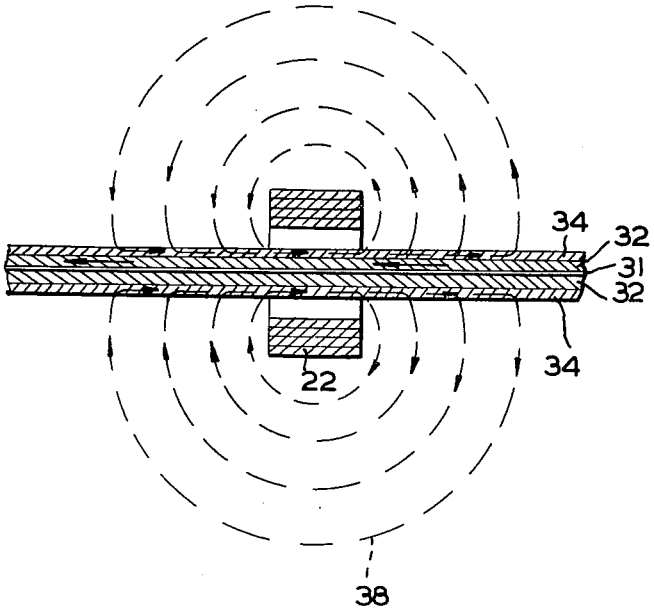
FIG. 4 is a representation of the cable and transformer being immersed in sea water where possible eddy current paths are shown.

FIG. 4 discloses the central conductor 31, insulation 32, metallic sheath 34, and a transformer core 22. The whole unit is pictured as operating in sea water where the possible eddy current paths in the sea water and in the metallic sheath 34 are shown.

An example of the typical dimensions of the torpedo detector and cable are as follows: The central conductor 31 is made of copper stranded wire equal to number 10 AWG. The insulation 32 on the conductor 31 is composed of cotton and rubber braid with a thickness of 0.03". The metallic sheath 34 is composed of two layers of carbon steel strands. The total outside diameter of the cable is equal to 5/16 of an inch. The plastic inner tube 12 has an inside dimension of $\frac{3}{8}$" and an outside dimension of $\frac{5}{8}$". The outer aluminum casing 16 has an outer diameter of 3" and the total detector unit 11 has a length of 30". The transformer core 22 is composed of Hypersil laminations 0.005" thick, with dimension D=$1\frac{1}{8}$", dimension E=5/16", dimension F=$\frac{5}{8}$", and dimension G=1-11/16". The weight of the transformer is 0.551 lbs. Winding 24 has 9 turns and an effective detector load resistance of 4 ohms was used.

An input current of 28 amperes at 800 cycles per second was used on conductor 10 of FIG. 1. The output voltage on winding 24 was 6.2 volts at 9.6 watts when the cable and detector were in air.

In this system the sea water is used for the return path of the 800 cycle current to avoid the necessity of a double cable which would practically eliminate the induced currents in the transformer . As described in Baker et al, supra, the central conductor is connected to a trailing electrode and an outer insulating layer 32 is used over the central conductor 31 to eliminate leakage currents 30 along the cable which would reduce the current at the ends of the cable. If a torpedo is detected the charge which is exploded will tear the insulating layer 32 off of the central conductor 31. Therefore a metallic sheath 34 had to be used over the insulating layer 32 as is shown in FIG. 2. However, induced eddy currents in the sheath 34 are generated by the 800 cycle current in the conductor 31 and therefore the magnetic field at the transformer core 22 is due to the difference between the current in the conductor 31 and the current in the sheath 34. These induced eddy currents also have a path at the ends of the detector through the sea water, the aluminum end plugs 14 and 15, and the aluminum casing 16, which currents are indicated by reference numeral 40 in FIG. 2.

As is indicated by FIG. 4 the induced eddy currents 38 in the sheath 34 and in the sea water will reduce the electromagnetic field at the transformer to a negligible amount and, in fact, an unreadable output was obtained at the winding 24 of the transformer. An aluminum inner tube 48 as shown in FIG. 5 of application Ser. No. 793,660, supra, also acts as an effective short circuit for the eddy currents and thereby reducing the output to an unmeasurable amount. The plastic inner tube 12 effectively acts as an insulator to reduce the eddy currents and to require them to travel a very long path as shown in FIG. 2 from the sheath 34, through the aluminum end plug 15, through the casing 16, back to the other end plug 14, and again through sea water to the metallic sheath 34. It has been found to be convenient to make this tube 12 of a saran plastic although other materials may be suitable. Inner tube 12 should have a fair mechanical strength and should be a good electrical insulator to avoid the short circuiting effects of the eddy currents which may be conducted or induced by a metallic inner tube.

When the system of FIG. 2 is immersed in sea water with the metallic sheath 34 connected to the central conductor 31 at the trailing end of the cable, the output of the transformer varies from about 62 to 87% along the length of the cable of the value previously given for air.

When the outer sheath 34 is used as a conductor, the output of the transformer varies from 10 to 46% along the length of the cable of the value previously given for air. The relatively poor efficiency shown by the second test is attributable to the leakage currents along the length of the cable, as shown at 30 in FIG. 1, which sharply reduce the actual cable current.

It will be noted that the saran tube 12 is adapted to slide on the metallic sheath 34 and, therefore, there is an additional sea water path between the tube 12 and the sheath 34. A current is induced in and conducted along this path in addition to those induced in the sheath 34, but, due to the long length of the path and the comparatively small area, these currents do not reduce the output of the transformer excessively. To compensate for any loss of current along the length of the cable the transformers are operated above the point of magnetic saturation and therefore a relatively constant voltage output has been achieved despite the small reduction due to eddy currents and the loss of effective currents along the length of the cable.

It should be understood, of course, that the foregoing disclosure relates to only a preferred embodiment of the invention and that it is intended to cover all changes and modifications of the examples of the invention herein chosen for the purposes of disclosure, which do not constitute departures from the spirit and scope of the invention.

What is claimed is:

1. A torpedo detector and explosive charge carrying device adapted to slide along an electrically energized cable comprising a shielding means adapted to slide on said cable for minimizing the effect of electrically induced edddy currents, and means for transferring power from said cable mounted within said shielding means.

2. A torpedo detector and explosive charge carrying device adapted to slide along an electrically energized cable comprising an electrically insulating inner tube adapted to slide along said cable, an outer casing attached to said inner tube, and means for transferring power from said cable mounted between said tube and said casing.

3. A torpedo detector and explosive charge carrying device adapted to slide along an electrically energized cable comprising an electrically insulating inner tube adapted to slide along said cable, transformer means mounted around said inner tube for transferring power from said cable, and an outer casing attached to said inner tube.

4. A torpedo detector and explosive charge carrying device adapted to slide along an electrically energized cable comprising an electrically insulating inner tube adapted to slide along said cable, a transformer core having a central window mounted around said inner tube so that said tube passes through said window, means for transferring energy from said core to energize said detector, and an outer casing attached to said inner tube at the ends thereof.

5. A torpedo detector and explosive charge carrying device adapted to slide along an electrically energized cable comprising a non-conductive inner tube adapted to slide along said cable, a transformer core having a central window mounted around said inner tube so that said tube passes through said window, an acoustic torpedo detector mounted outside of said tube, means for transferring power from said transformer core to said detector connected between said core and said detector, and an outer casing attached to said inner tube at the ends thereof.

6. A torpedo detecting and explosive charge carrying mechanism comprising an electrically conductive cable, a shielding means adapted to slide on said cable for minimizing the effect of electrically induced eddy currents, and means for transferring power from said cable mounted within said shielding means.

7. A torpedo detecting and explosive charge carrying mechanism according to claim 6 but further characterized by said cable comprising a central conductor and an outer insulating covering.

8. A torpedo detecting and explosive charge carrying mechanism according to claim 6 but further characterized by said cable comprising a central conductor, an insulating covering mounted on said inner conductor, and a metallic sheath mounted on said insulating covering.

9. A torpedo detector and explosive charge carrying device adapted to slide along an electrically energized cable comprising a central conductor, an insulating covering mounted or said inner conductor, and a metallic sheath mounted on said insulating covering, a non-conductive inner tube adapted to slide along said cable, a transformer core having a central window mounted around said inner tube so that said tube passes through said window, an acoustic torpedo detector mounted outside of said tube, means for transferring power from said transformer core to said detector connected between said core and said detector, and an outer casing attached to said inner tube at the ends thereof.

* * * * *